US011525625B2

(12) United States Patent
Hanson et al.

(10) Patent No.: US 11,525,625 B2
(45) Date of Patent: Dec. 13, 2022

(54) MULTI ACCESSORY RACK

(71) Applicant: Electrolux Home Products, Inc., Charlotte, NC (US)

(72) Inventors: Joshua Hanson, Huntersville, NC (US); Brian Roesch, Anderson, SC (US)

(73) Assignee: Electrolux Home Products, Inc, Charlotte, NC (US)

( * ) Notice: Subject to any disclaimer, the term of this patent is extended or adjusted under 35 U.S.C. 154(b) by 0 days.

(21) Appl. No.: 17/114,078

(22) Filed: Dec. 7, 2020

(65) Prior Publication Data

US 2022/0178608 A1 Jun. 9, 2022

(51) Int. Cl.
*F25D 25/02* (2006.01)

(52) U.S. Cl.
CPC ..... *F25D 25/024* (2013.01); *F25D 2325/023* (2013.01)

(58) Field of Classification Search
CPC ..... F25D 2325/023; F25D 2331/803; F25D 2331/805
See application file for complete search history.

(56) References Cited

U.S. PATENT DOCUMENTS

| | | | | |
|---|---|---|---|---|
| 4,944,566 | A | 7/1990 | Carper | |
| 7,950,755 | B2 | 5/2011 | Vardon | |
| 10,408,530 | B1 | 9/2019 | Beck | |
| 10,408,531 | B1 | 9/2019 | Beck | |
| 10,415,874 | B1 | 9/2019 | Beck | |
| 10,823,491 | B2 | 11/2020 | Beck | |
| 11,371,771 | B2 | 6/2022 | Alves Ferreira et al. | |
| 2006/0266905 | A1* | 11/2006 | Becke | F25D 25/021 248/302 |
| 2009/0058247 | A1* | 3/2009 | Collins | F25D 25/02 312/408 |
| 2017/0343276 | A1* | 11/2017 | Cheon | F25D 23/067 |
| 2018/0328653 | A1* | 11/2018 | Alves Ferreira | F25D 25/025 |
| 2020/0088460 | A1 | 3/2020 | Beck | |

FOREIGN PATENT DOCUMENTS

| | | | | |
|---|---|---|---|---|
| CN | 201653056 | | 11/2010 | |
| CN | 202254617 U | * | 5/2012 | F25D 25/02 |
| CN | 102506556 A | * | 6/2012 | F25D 23/04 |
| CN | 105180583 | | 12/2015 | |
| DE | 19631372 A1 | * | 2/1998 | A47B 73/008 |

(Continued)

OTHER PUBLICATIONS

Description W02013143909A1, 5 pages (Year: 2013).*

(Continued)

*Primary Examiner* — Andrew M Roersma
(74) *Attorney, Agent, or Firm* — Peame & Gordon LLP

(57) ABSTRACT

An accessory rack includes a pair of support arms. Each support arm includes a rail that is configured to slidably receive and retain a retention feature formed on an accessory item. Each rail is spaced apart based on a predetermined width that corresponds to the distance between retention features disposed on the sides of one or more, interchangeable accessory items. The accessory rack may be slidably coupled to an existing refrigerator shelf assembly. A refrigerator shelf assembly may include an integrated accessory rack.

11 Claims, 12 Drawing Sheets

(56) References Cited

FOREIGN PATENT DOCUMENTS

| | | | | |
|---|---|---|---|---|
| DE | 19631374 | A1 * | 2/1998 | ..... F25D 25/02 |
| DE | 19949238 | A1 * | 4/2001 | ..... F25D 23/04 |
| EP | 0917639 | | 5/1999 | |
| EP | 2516944 | | 10/2012 | |
| EP | 2913610 | B1 * | 4/2019 | ..... A47B 88/407 |
| KR | 20040100494 | | 12/2004 | |
| KR | 100965358 | | 1/2010 | |
| WO | 98/05910 | | 2/1998 | |
| WO | WO-2011076833 | A2 * | 6/2011 | ..... F25D 31/007 |
| WO | WO-2013127070 | A1 * | 9/2013 | ..... F25D 25/02 |
| WO | 2013143909 | | 10/2013 | |

OTHER PUBLICATIONS

Partial International Search Report for PCT/US2021/061572, dated Mar. 31, 2022, 2 pages.
International Search Report and Written Opinion for PCT/US2021/061572, dated May 25, 2022, 16 pages.

* cited by examiner

MULTI ACCESSORY RACK

FIELD OF THE INVENTION

This application relates generally to an accessory rack assembly for a refrigeration appliance, and more particularly, to a multi-accessory rack including a pair of rails that are configured to support a variety of interchangeable, accessory items therefrom.

BACKGROUND OF THE INVENTION

Conventional refrigeration appliances, such as domestic refrigerators, typically have both a fresh food compartment and a freezer compartment or section. The fresh food compartment is where food items such as fruits, vegetables, and beverages are stored and the freezer compartment is where food items that are to be kept in a frozen condition are stored. The refrigerators are provided with a refrigeration system that maintains the fresh food compartment at temperatures above 0° C., such as between 0.25° C. and 4.5° C. and the freezer compartments at temperatures below 0° C., such as between 0° C. and −20° C.

The arrangements of the fresh food and freezer compartments with respect to one another in such refrigerators vary. For example, in some cases, the freezer compartment is located above the fresh food compartment and in other cases the freezer compartment is located below the fresh food compartment. Additionally, many modern refrigerators have their freezer compartments and fresh food compartments arranged in a side-by-side relationship. Whatever arrangement of the freezer compartment and the fresh food compartment is employed, typically, separate access doors are provided for the compartments so that either compartment may be accessed without exposing the other compartment to the ambient air.

Conventional refrigerator appliances typically include at least one or more shelves that are vertically spaced and configured to store various food items thereon. In such appliances, an idle space or volume typically exists between the food items stored on a shelf and an adjacent shelf located above the food items, thereby compromising the space utilization of the appliance.

BRIEF SUMMARY OF THE INVENTION

The following presents a simplified summary of the disclosure in order to provide a basic understanding of some example aspects described in the detailed description. This summary is not an extensive overview. Moreover, this summary is not intended to identify critical elements of the disclosure nor delineate the scope of the disclosure. The sole purpose of the summary is to present some concepts in simplified form as a prelude to the more detailed description that is presented later.

In accordance with one aspect, there is provided an accessory rack for suspending interchangeable accessory items from a refrigerator shelf, the accessory rack comprising a first support arm and a second support arm spaced apart and connected by a front cross member and a rear cross member, wherein the first support arm and the second support arm each comprises a first attachment member that is configured to couple a front portion of the accessory rack to a front portion of a refrigerator shelf; wherein the accessory rack further comprises a first rail and a second rail, wherein the first rail is disposed on the first support arm, and wherein the second rail is disposed on the second support arm, wherein the rear cross member includes a second attachment member that is configured to couple a rear portion of the accessory rack to a rear portion of said shelf, wherein the first rail and the second rail are configured to support an accessory item comprising a pair of retention features that are spaced apart by a predetermined width, and wherein the first rail and the second rail are spaced apart based on said predetermined width such that said accessory item may be suspended from the first rail and the second rail via said pair of retention features.

In accordance with yet another aspect, there is provided a refrigerator shelf, comprising a planar panel for storing items thereon, the panel including a front trim member and a rear trim member; wherein the refrigerator shelf further comprises an accessory rack attached to the front trim member and to the rear trim member, the accessory rack being adapted to suspend interchangeable accessory items from the refrigerator shelf; wherein the accessory rack comprises a first support arm and a second support arm spaced apart and connected by a front cross member and a rear cross member, and a first rail and a second rail, wherein the first rail is coupled to the first support arm, and wherein the second rail is coupled to the second support arm, wherein the first support arm and the second support arm each comprises a first attachment member that is configured to couple the accessory rack to the front trim member, and wherein the rear cross member includes a second attachment member that is configured to couple the accessory rack to the rear trim member, wherein the first rail and the second rail are configured to support an accessory item having a pair of retention features that are spaced apart by a predetermined width, and wherein the first rail and the second rail are spaced apart based on said predetermined width such that said accessory item may be suspended from the first rail and the second rail via said pair of retention features.

A refrigerator shelf, comprising a front trim member and a rear trim member, and a first support arm and a second support arm spaced apart and connected by the front trim member and the rear trim member; wherein the refrigerator shelf further comprises a planar panel provided on the first support arm and the second support arm for storing items thereon, wherein the first support arm comprises a first rail, and wherein the second support arm comprises a second rail, wherein the first rail and the second rail are configured to support an accessory item having a pair of retention features that are spaced apart by a predetermined width, and wherein the first rail and the second rail are spaced apart based on said predetermined width such that said accessory item may be suspended from first rail and the second rail via said pair of retention features.

It is to be understood that both the foregoing general description and the following detailed description present embodiments of the present disclosure, and are intended to provide an overview or framework for understanding the nature and character of the embodiments as they are described and claimed. The accompanying drawings are included to provide a further understanding of the embodiments, and are incorporated into and constitute a part of this specification. The drawings illustrate various embodiments of the disclosure and together with the description serve to explain the principles and operations thereof.

BRIEF DESCRIPTION OF THE DRAWINGS

These and other features, aspects and advantages of the present disclosure can be further understood when read with reference to the accompanying drawings.

DESCRIPTION OF EXAMPLE EMBODIMENTS

Figure 1:
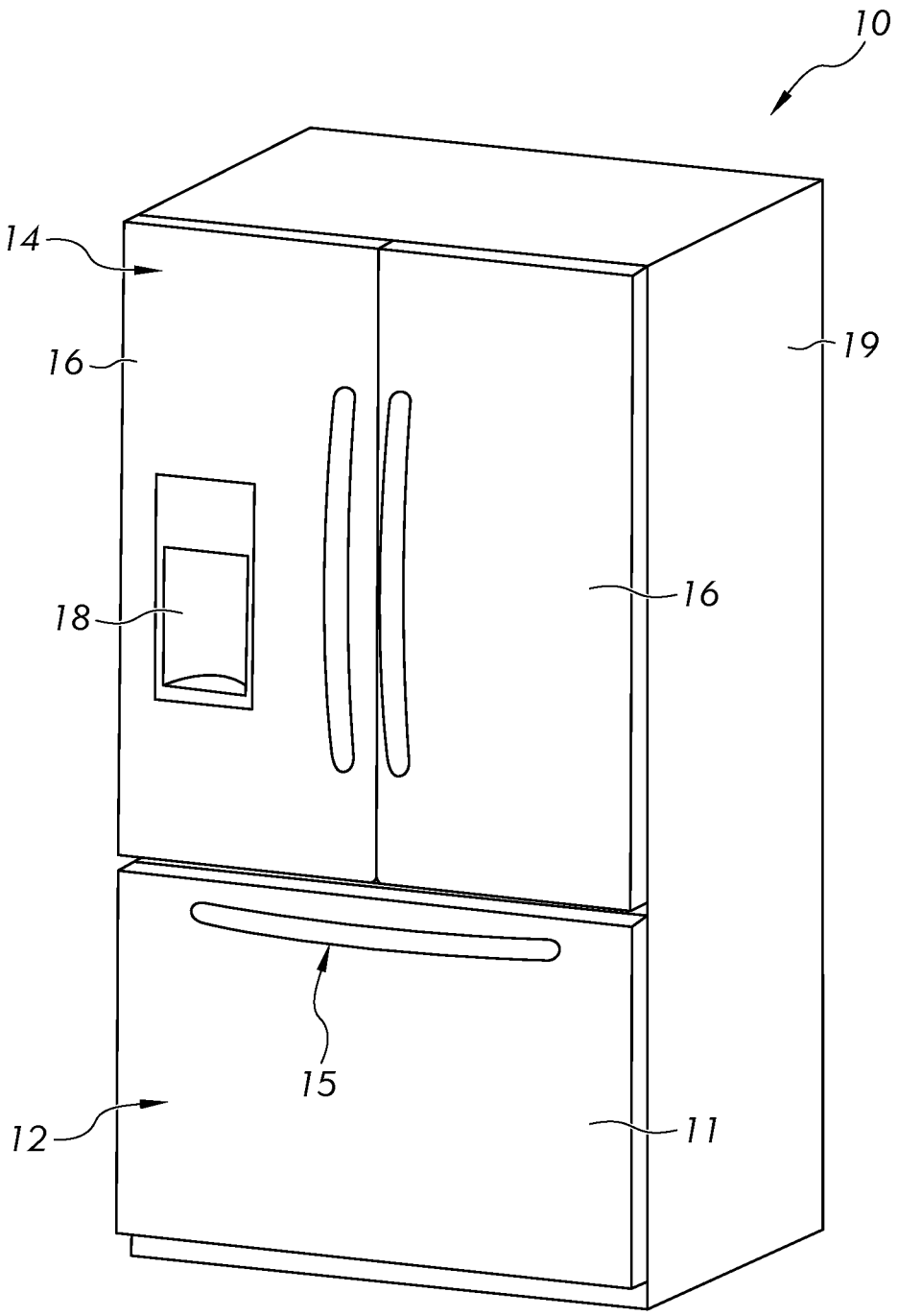
FIG. 1 is a front perspective view of a household French Door Bottom Mount refrigerator wherein doors of the refrigerator are in a closed position.

Apparatus will now be described more fully hereinafter with reference to the accompanying drawings in which embodiments of the disclosure are shown. Whenever possible, the same reference numerals are used throughout the drawings to refer to the same or like parts. However, this disclosure may be embodied in many different forms and should not be construed as limited to the embodiments set forth herein.

Referring now to the drawings, FIG. 1 shows a refrigeration appliance in the form of a domestic refrigerator, indicated generally at 10. Although the detailed description that follows concerns a domestic refrigerator 10, the invention can be embodied by refrigeration appliances other than with a domestic refrigerator 10. Further, an embodiment is described in detail below, and shown in the figures as a bottom-mount configuration of a refrigerator 10, including a fresh food compartment 14 disposed vertically above a freezer compartment 12. However, the refrigerator 10 can have any desired configuration including at least one of a fresh food compartment 14 and/or a freezer compartment 12, such as a top mount refrigerator (freezer disposed above the fresh food compartment), a side-by-side refrigerator (fresh food compartment is laterally next to the freezer compartment), a standalone refrigerator or freezer having a single main compartment, etc.

Figure 2:
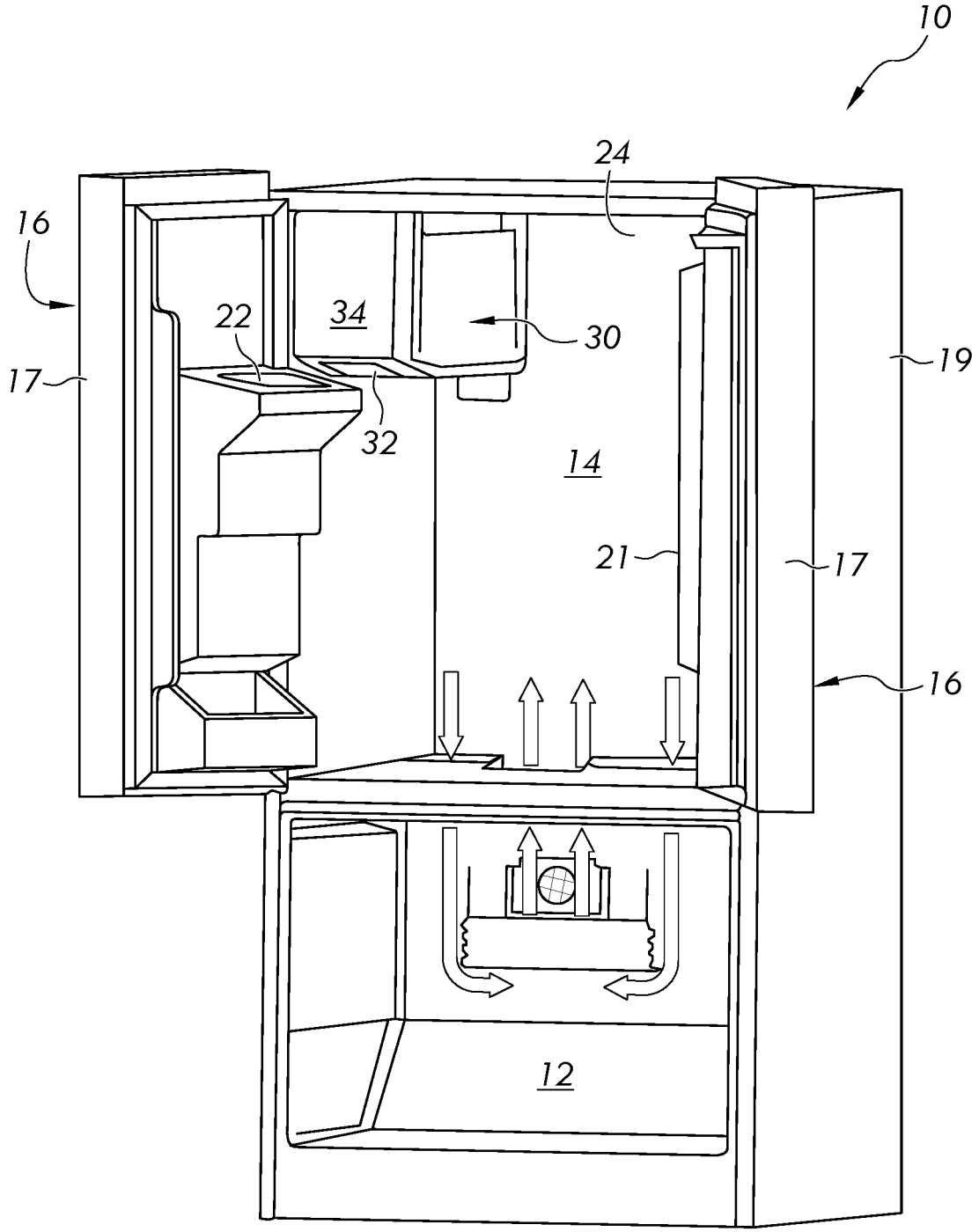
FIG. 2 is a front perspective view of the refrigerator of FIG. 1 showing the doors in an opened position and an interior of a fresh food compartment.

One or more doors 16 shown in FIG. 1 are pivotally coupled to a cabinet 19 of the refrigerator 10 to restrict and grant access to the fresh food compartment 14. The door 16 can include a single door that spans the entire lateral distance across the entrance to the fresh food compartment 14, or can include a pair of French-type doors 16 as shown in FIG. 1 that collectively span the entire lateral distance of the entrance to the fresh food compartment 14 to enclose the fresh food compartment 14. For the latter configuration, a center flip mullion 21 (FIG. 2) is pivotally coupled to at least one of the doors 16 to establish a surface against which a seal provided to the other one of the doors 16 can seal the entrance to the fresh food compartment 14 at a location between opposing side surfaces 17 (FIG. 2) of the doors 16. The mullion 21 can be pivotally coupled to the door 16 to pivot between a first orientation that is substantially parallel to a planar surface of the door 16 when the door 16 is closed, and a different orientation when the door 16 is opened. The externally-exposed surface of the center mullion 21 is substantially parallel to the door 16 when the center mullion 21 is in the first orientation, and forms an angle other than parallel relative to the door 16 when the center mullion 21 is in the second orientation. The seal and the externally-exposed surface of the mullion 21 cooperate approximately midway between the lateral sides of the fresh food compartment 14.

A dispenser 18 (FIG. 1) for dispensing at least ice pieces, and optionally water, can be provided on an exterior of one of the doors 16 that restricts access to the fresh food compartment 14. The dispenser 18 includes an actuator (e.g., lever, switch, proximity sensor, etc.) to cause frozen ice pieces to be dispensed from an ice bin 34 (FIG. 2) of an ice maker 30 disposed within the fresh food compartment 14. Ice pieces from the ice bin 34 can exit the ice bin 34 through an aperture 32 and be delivered to the dispenser 18 via an ice chute 22 (FIG. 2), which extends at least partially through the door 16 between the dispenser 18 and the ice bin 34.

Referring to FIG. 1, the freezer compartment 12 is arranged vertically beneath the fresh food compartment 14. A drawer assembly (not shown) including one or more freezer baskets (not shown) can be withdrawn from the freezer compartment 12 to grant a user access to food items stored in the freezer compartment 12. The drawer assembly can be coupled to a freezer door 11 that includes a handle 15. When a user grasps the handle 15 and pulls the freezer door 11 open, at least one or more of the freezer baskets is caused to be at least partially withdrawn from the freezer compartment 12.

In alternative embodiments, the ice maker is located within the freezer compartment. In this configuration, although still disposed within the freezer compartment, at least the ice maker (and possible an ice bin) is mounted to an interior surface of the freezer door. It is contemplated that the ice mold and ice bin can be separate elements, in which one remains within the freezer compartment and the other is on the freezer door.

The freezer compartment 12 is used to freeze and/or maintain articles of food stored in the freezer compartment 12 in a frozen condition. For this purpose, the freezer compartment 12 is in thermal communication with a freezer evaporator (not shown) that removes thermal energy from the freezer compartment 12 to maintain the temperature therein at a temperature of 0° C. or less during operation of the refrigerator 10, preferably between 0° C. and −50° C., more preferably between 0° C. and −30° C. and even more preferably between 0° C. and −20° C.

The refrigerator 10 includes an interior liner 24 (FIG. 2) that defines the fresh food compartment 14. The fresh food compartment 14 is located in the upper portion of the refrigerator 10 in this example and serves to minimize spoiling of articles of food stored therein. The fresh food compartment 14 accomplishes this by maintaining the temperature in the fresh food compartment 14 at a cool temperature that is typically above 0° C., so as not to freeze the articles of food in the fresh food compartment 14. It is contemplated that the cool temperature preferably is between 0° C. and 10° C., more preferably between 0° C.

and 5° C. and even more preferably between 0.25° C. and 4.5° C. According to some embodiments, cool air from which thermal energy has been removed by the freezer evaporator can also be blown into the fresh food compartment 14 to maintain the temperature therein greater than 0° C. preferably between 0° C. and 10° C., more preferably between 0° C. and 5° C. and even more preferably between 0.25° C. and 4.5° C. For alternate embodiments, a separate fresh food evaporator can optionally be dedicated to separately maintaining the temperature within the fresh food compartment 14 independent of the freezer compartment 12. According to an embodiment, the temperature in the fresh food compartment 14 can be maintained at a cool temperature within a close tolerance of a range between 0° C. and 4.5° C., including any subranges and any individual temperatures falling with that range. For example, other embodiments can optionally maintain the cool temperature within the fresh food compartment 14 within a reasonably close tolerance of a temperature between 0.25° C. and 4° C.

Figure 3:
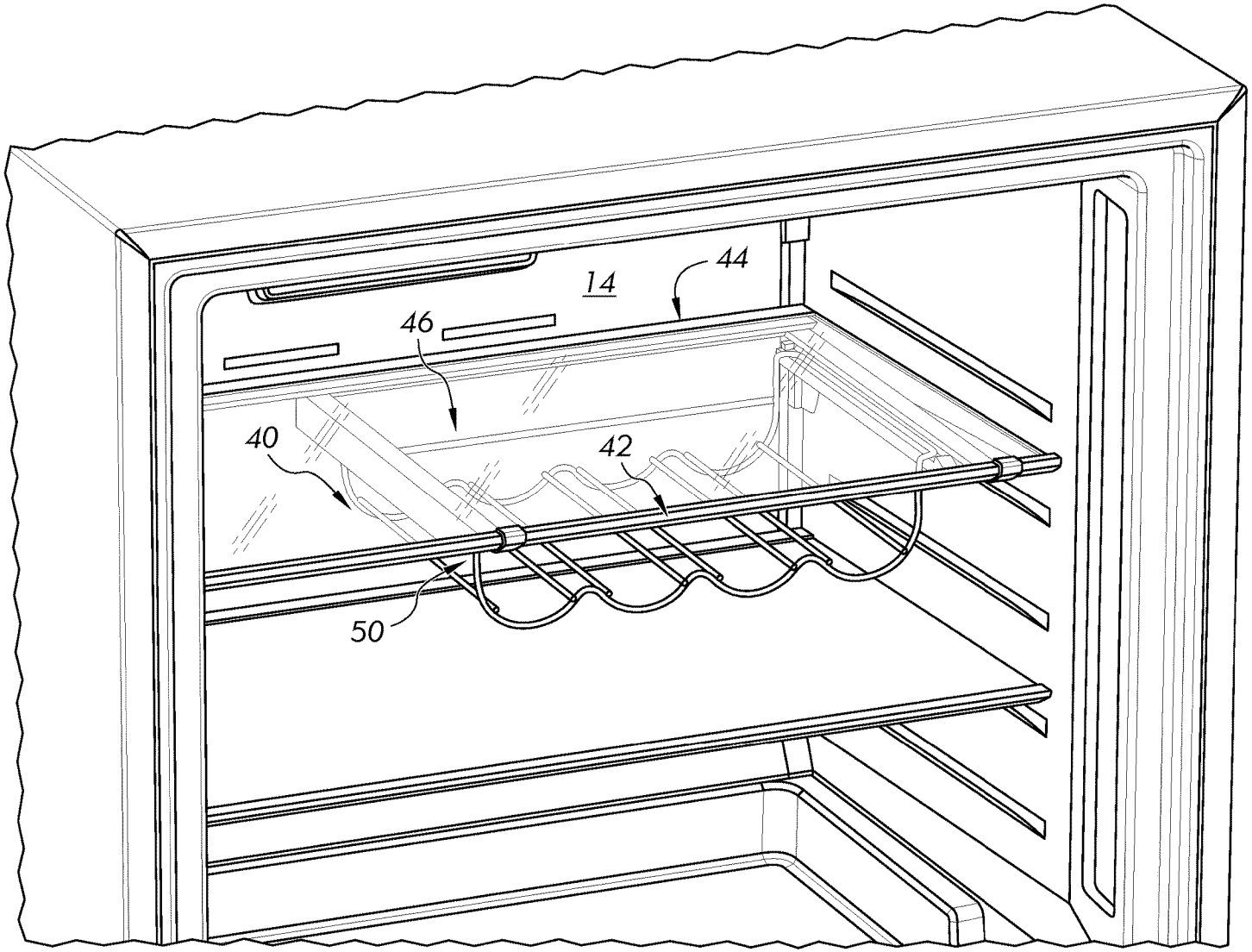
FIG. 3 is a front perspective view of a multi-accessory rack coupled to a refrigerator shelf with a bottle and can rack suspended therefrom.

Turning now to FIG. 3, an example of an accessory rack 50 is shown removably attached to a refrigerator shelf assembly 40 located in the fresh food compartment 14 of the appliance 10. Generally, the accessory rack 50 represents an auxiliary device that increases the space utilization of a refrigerator appliance by utilizing idle space located directly underneath the shelf assembly 40 to locate a variety of interchangeable, accessory items (e.g., wine bottle & can racks, hanging shelves, metal or stone baking trays, thawing trays, storage containers, glass baking wares, leftover containers, lunchbox containers, and the like).

Figure 4:
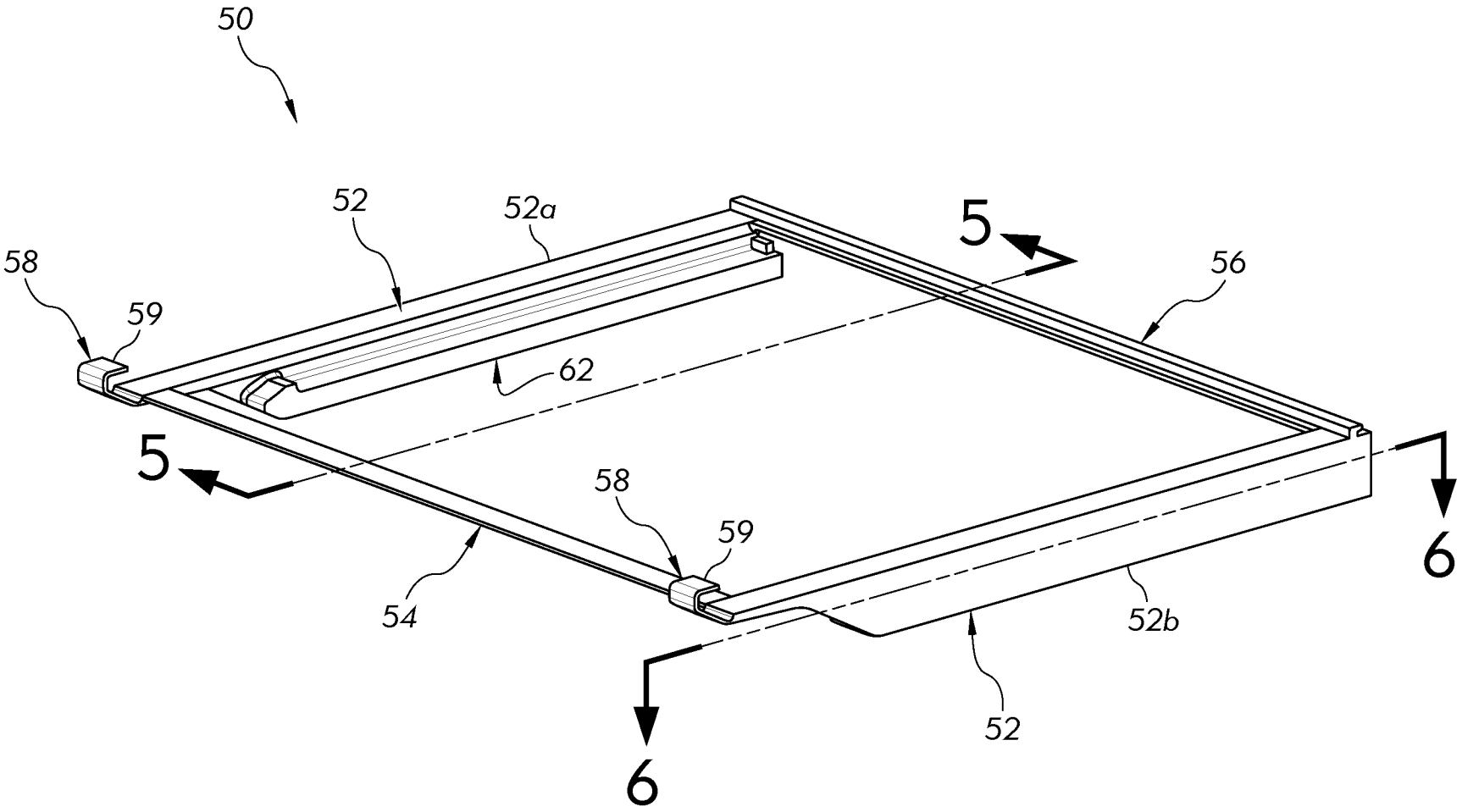
FIG. 4 is a front perspective view of the multi-accessory rack.

As shown in FIG. 4, the accessory rack 50 includes a pair of support arms 52 that are configured to slidably receive and retain an accessory item (e.g., accessory item 80 in FIG. 7A) so that the accessory item is situated directly underneath the shelf assembly 40 when suspended from the accessory rack 50, as described in greater detail below. In the illustrated embodiment, the accessory rack 50 embodies a support frame comprising a first support arm 52*a* and a second support arm 52*b* that are connected by a front cross member 54 and a rear cross member 56. In some examples, the accessory rack 50 can be formed as a monolithic, unitary structure, such as, for example, when the accessory rack 50 is manufactured employing an injection molding process. Yet, it should be appreciated that other configurations are also contemplated. For instance, the support arms 52 can be coupled to the front cross member 54 and to the rear cross member 56 utilizing removable fasteners (e.g., screws, nuts, bolts, etc.). In further examples, the accessory rack 50 can be made from a rigid material suitable for use in a refrigerator appliance (e.g., stainless steel, aluminum, plastic, etc.).

Still referring to FIG. 4, each support arm 52 can include a first attachment member 58 that is configured to couple the accessory rack 50 to a front trim member 42 (FIG. 3) of the shelf assembly 40. In the illustrated embodiment, the first attachment member 58 comprises a forward-facing clip 59 that is configured to latch onto the front trim member 42 of the shelf assembly 40 located within the appliance. In some examples, the first attachment member 58 has an inner profile that is complimentary to the exterior contour of the front trim member 42, respectfully, so that the first attachment member 58 is in a mating arrangement with the front trim member 42 when it is coupled to the front trim member 42. Yet, in alternative embodiments, the first attachment member 58 may comprise other attachment means, such as, for example, resilient snaps, resilient clips, clasps, hooks, keys & slots, or any other suitable attachment means described in the present application. For example, each support arm 52 may include one or more projecting lips that are configured to be inserted into a channel (not shown) formed on the front trim member 42.

Figure 5:
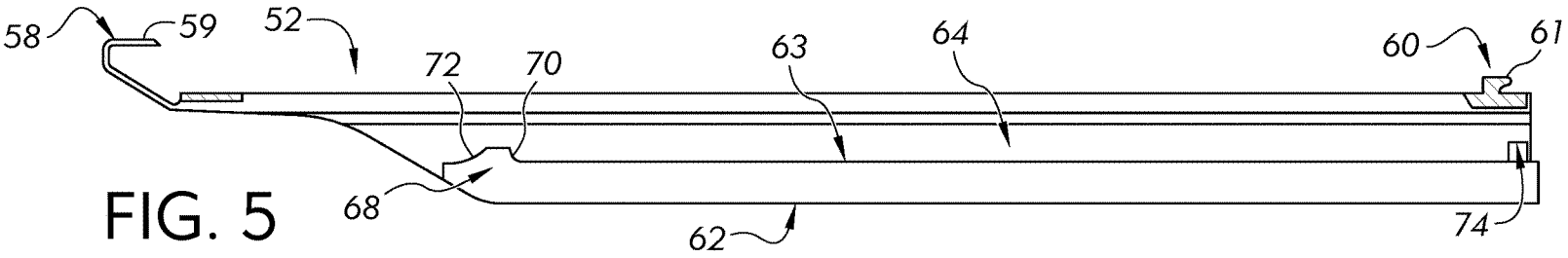
FIG. 5 is a cross-section view of the multi-accessory taken along line 5-5 in FIG. 4.

Referring to FIG. 5, a second attachment member 60 is disposed on the rear cross member 56 for coupling the accessory rack 50 to the rear trim member 44 of the shelf assembly 40. In this manner, when the first attachment member 58 is coupled to the front trim member 42, and the second attachment member 60 is coupled to the rear trim member 44, the accessory rack 50 is configured to transfer the load imposed by the weight of the accessory item 80 to the shelf assembly 40. In the illustrated embodiment, the second attachment member 60 comprises an elongated, L-shaped lip 61 that is configured to be inserted into a longitudinal channel (not shown) formed in a rear trim member 44 of the shelf assembly 40. However, it should be appreciated that other configurations for attaching the rear cross member 56 to the rear trim member 44 are also contemplated. For example, the second attachment member 60 may comprise any other suitable attachment means described herein (e.g., resilient snaps, resilient clips, clasps, hooks, key/slot arrangements).

In another example, the first attachment members 58 and the second attachment member 60 may comprise low-friction, self-lubricating material (e.g., ABS, polypropylene) so that the accessory rack 50 can slide laterally within the appliance relative to the front trim member 42 and the rear trim member 44, respectively. This feature is particularly beneficial when repositioning the accessory rack 50 in refrigerators having a single, elongated shelf that extends from a left wall to a right wall of the refrigerator compartment 14, although it is to be appreciated that the accessory rack 50 can be used with other relatively shorter shelves that extend less than a full width of the refrigerator compartment.

Figure 6:
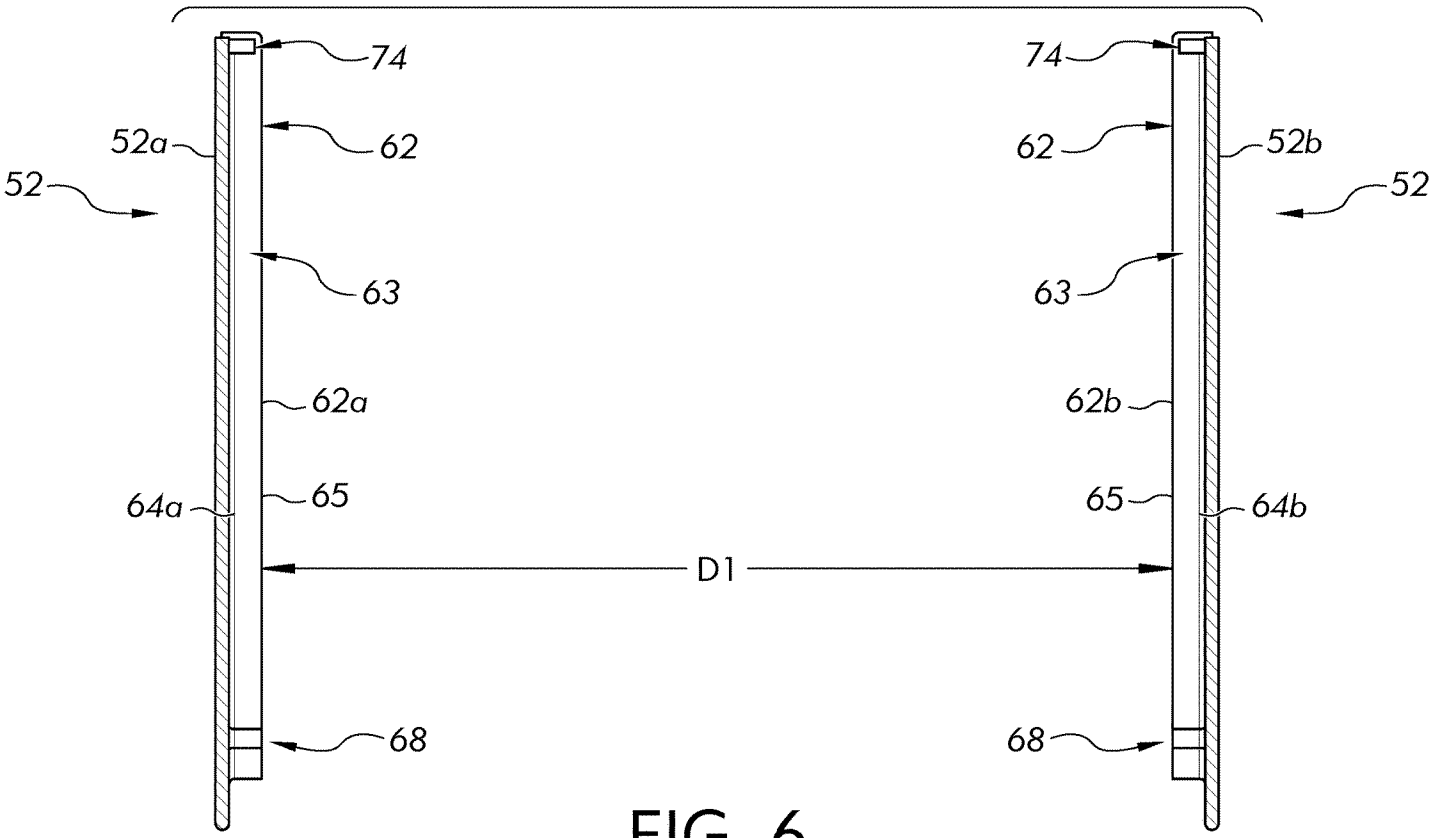
FIG. 6 is a cross-section view of the multi-accessory rack taken along line 6-6 in FIG. 4.

Referring to FIGS. 5-7B, each support arm 52 can include a longitudinal track or rail 62 (FIGS. 5 and 6) that is shaped and dimensioned to cooperate with a retention feature 82 (FIGS. 7A and 7B) disposed on each side of an accessory item 80, respectfully, for suspending the accessory item 80 from the support arms 52, as described in detail below. Referring to FIGS. 5 and 6, each rail 62 may comprise a substantially flat, upper surface 63 that is configured to slidably receive a retention feature 82 (FIG. 7A) that is to be seated thereon. In the illustrated embodiment, a first rail 62*a* is disposed on an inner wall 64*a* of the first support arm 52*a*, and a second rail 62*b* is disposed on an inner wall 64*b* of the second support arm 52*b*. In some examples, each rail 62 can be integrally formed on the inner wall 64 of each support arm 52, such as, for example, in such embodiments where each support arm 52 and rail 62 are injection molded as a monolithic, unitary structure.

As discussed above, the upper surface 63 of each rail 62 is configured to slidably receive the retention feature 82 disposed on the side of the accessory item 80 such that the retention feature 82 may be seated thereon. In this manner, the accessory item 80 can be placed into the accessory rack 50 by sliding the retention features 82 disposed on the sides of the accessory item 80 along the upper surfaces 63 of the rails 62 until the accessory item 80 is located directly underneath the shelf assembly 40. In some examples, each rail 62 may comprise a self-lubricating material (e.g., ABS, polypropylene) so that the retention features 82 can glide along the upper surfaces 63 of the rails 62. In further embodiments (not shown), each rail 62 may comprise a longitudinal slot or groove formed therein for slidably receiving a complimentary, sliding member disposed on each side of the accessory item 80.

Figure 7A:
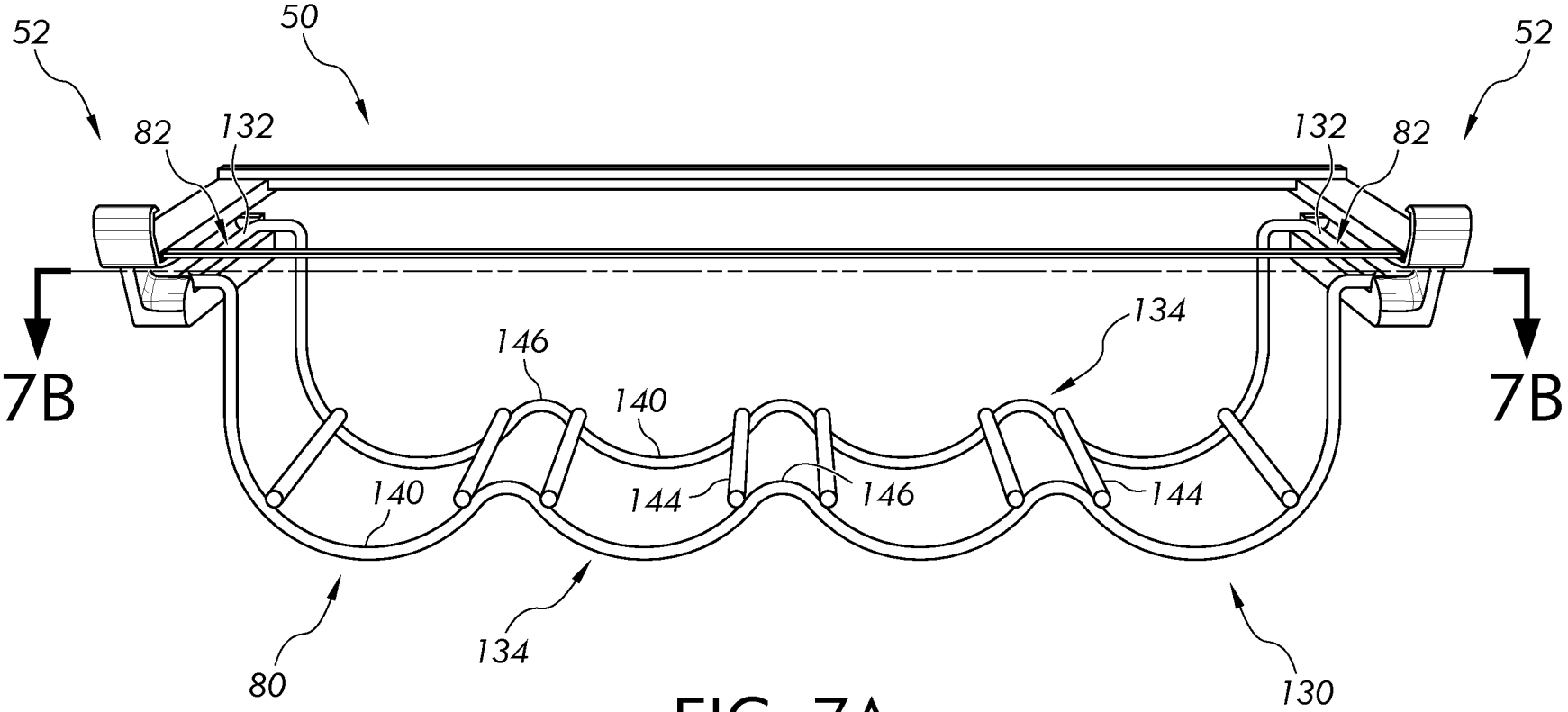
FIG. 7A is a front perspective view of a bottle and can rack suspended from the multi-accessory rack.
Figure 8A:
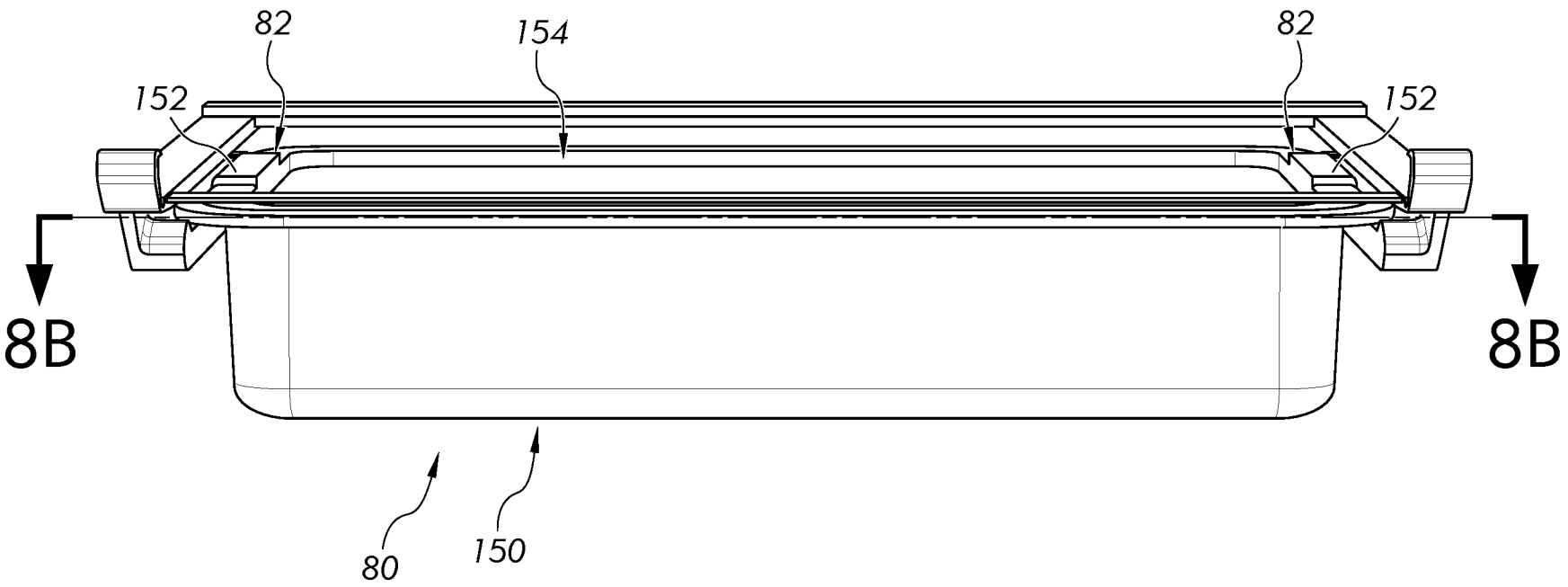
FIG. 8A is a front perspective view of a storage container suspended from the multi-accessory rack.

Referring to FIG. 7A, each retention feature 82 may comprise an elongated wire member 132 that protrudes laterally from the accessory item 80, particularly, in such embodiments where the accessory item 80 comprises a wine bottle & can rack 130 or other accessory item comprised of shaped-wire. In the illustrated embodiment, the elongated wire member 132 is configured to slide along the upper surface 63 of each rail 62 and be seated thereon for suspending the wine bottle & can rack 130 from the accessory rack 50. Yet, in other examples, each retention feature 82 may comprise a protruding lip 152 or flange (FIGS. 8A-8B) formed along an edge of a storage container 150 and/or lid 154 therefor. Yet, in other embodiments (not shown), each retention feature 82 may comprise rollers that are configured to roll along the upper surface 63 of each rail 62. In further embodiments, each retention feature 82 may comprise a sliding member that is configured to be slidably received by a longitudinal slot formed in each rail 62. Moreover, in some embodiments, resilient snaps, clasps, clips, or hooks may also be used to removably attach the accessory item 80 to the support arms 52. In this manner, it should be understood that a wide variety of arrangements are contemplated for removably attaching the accessory item 80 to the accessory rack 50.

Figure 7B:
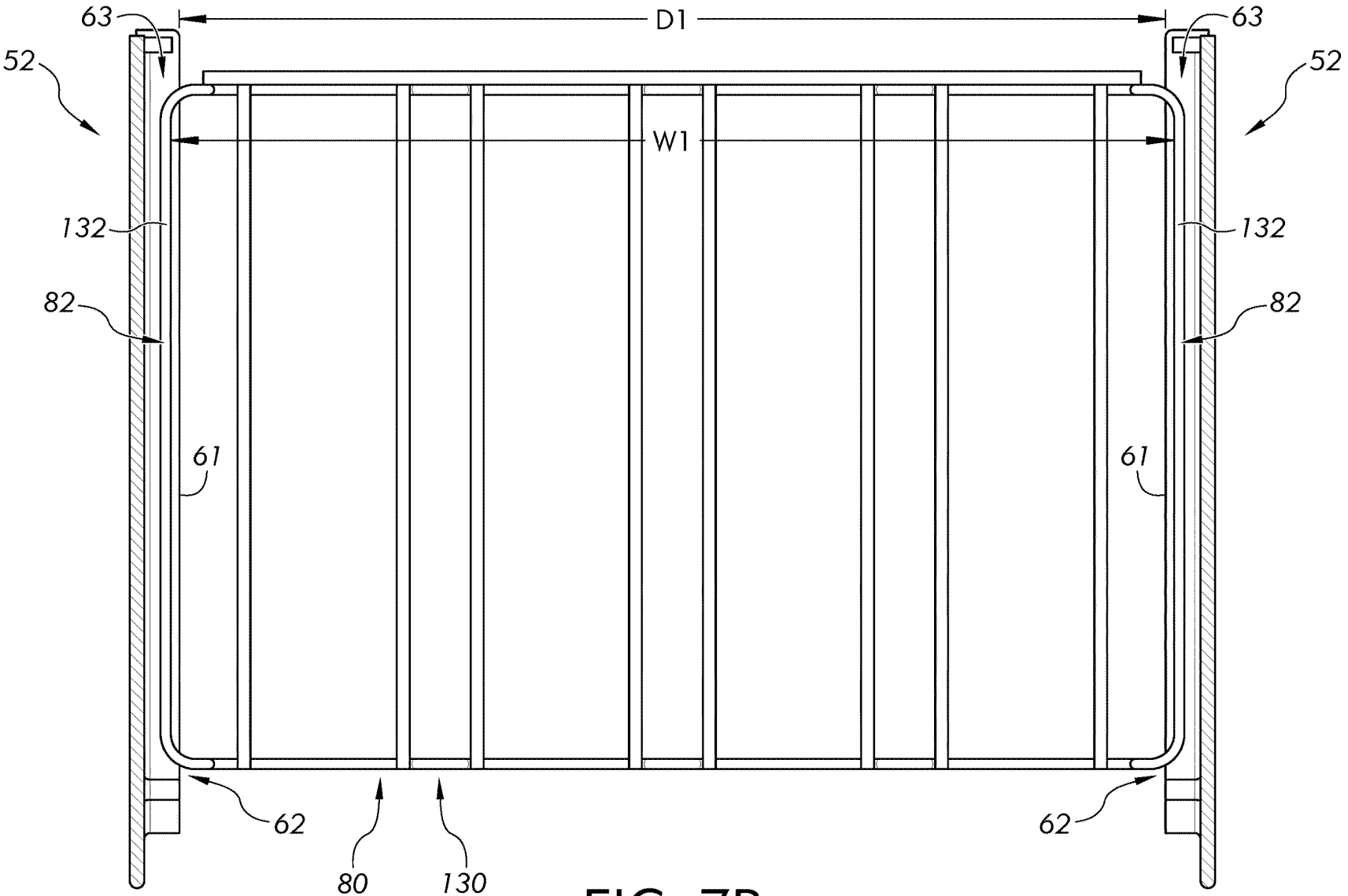
FIG. 7B is a cross-section view of the multi-accessory rack taken along line 7B-7B in FIG. 7A.
Figure 8B:
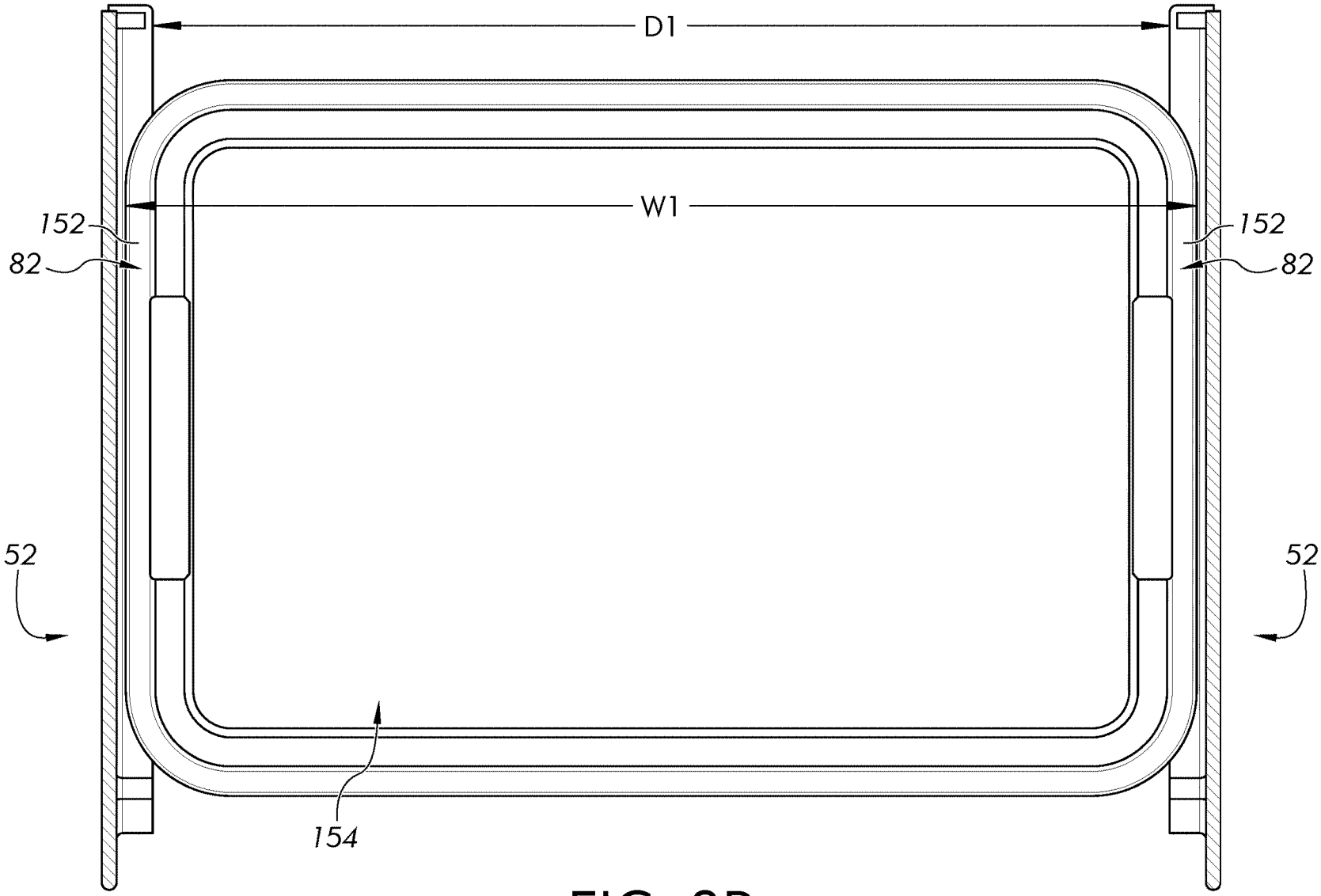
FIG. 8B is a cross-section view of the multi-accessory rack taken long line 8B-8B in FIG. 8A.

Turning back to FIG. 6, in some examples, the rails 62 are dimensioned and spaced apart by a calculated distance D1 that is based on a predetermined width W1 (FIG. 7B) corresponding to the spacing between the retention features 82 disposed on the sides of the accessory item 80. For example, as shown in FIG. 7B, the calculated distance D1 can be based on the predetermined width W between the elongated wire members 132 disposed on each side of the wine bottle & can rack 130. Alternatively, as shown in FIG. 8B, the calculated distance D1 can be based on the predetermined width W1 between the protruding lips 152 disposed on each side of the storage container 150 and/or lid 154. In such examples, the dimension of the calculated distance D1 is slightly less than the predetermined width W1 such that each retention feature 82 may extend past an inner-facing edge 65 (FIG. 6) of each rail 62. Accordingly, each retention feature 82 can be seated on the upper surface 63 of a respective rail 62 for suspending the accessory item 80 therefrom. Moreover, the rails 62 may also be sized and dimensioned to provide adequate clearance for accommodating protruding features that extend past an edge of the accessory item 80, such as, for example, the storage container lid 154 (FIG. 8) or an oversized cover. In such examples, the upper surface 63 of each rail 62 can be made wider to accommodate the lid 154 or the cover without affecting the sealing function of the lid 154 and/or a gasket (not shown) disposed therein.

Thus, it should be appreciated that the accessory rack 50 of the present application comprises a standardized design that can be sized and dimensioned to accommodate a variety of interchangeable, accessory items, such as, for example any form of an accessory item described herein, e.g., wine bottle & can rack, hanging shelf, baking tray, thawing tray, storage container having a lid, and the like.

Turning back to FIG. 5, a front portion of each rail 62 may optionally include a stop projection 68 (FIG. 5) that is configured to restrain the retention feature 82 disposed on the side of the accessory item 80, respectfully, for preventing the accessory item 80 item from sliding off the rails 62 (e.g., when the accessory item 80 is inadvertently pushed forward). More specifically, a rear wall 70 (FIG. 5) can be formed into the stop projection 68 to define a limit or restraint at a front portion of each rail 62. In some embodiments, a ramp 72 can be formed at a front portion of each stop projection 68 to help guide an accessory item 80 onto the rails 62 of the accessory rack 50. More specifically, each ramp 72 can be upwardly inclined to help guide the insertion of the retention features 82 onto the rails 62. While the illustrated embodiment depicts the ramp 72 as a generally concaved surface, it should be appreciated that other configurations are also contemplated. For instance, each ramp 72 may comprise a convex-shaped surface or an inclined surface having a constant slope.

In addition or alternatively, each rail 62 may include a standoff 74 formed on or coupled to a rear portion of the rail 62 to restrain the retention feature 82 from sliding past the standoff 74, particularly, for preventing the accessory item 80 from contacting a rear wall of the liner 24 when the accessory item 80 is pushed into the compartment 14. Yet in other embodiments (not shown), the upper surface 63 of each rail 62 may include a gripping segment disposed thereon to serve as an impediment surface for restraining the retention feature 82 from sliding off the rail 62. For example, a rubber inlay (not shown) can be provided on and/or formed into the upper surface 63 of each rail 62 to prevent the retention feature 82 from sliding thereon. In this aspect, it should be understood that the gripping segment may also be functionally suited to help suspend the accessory item 80 from the accessory rack 50, particularly, based on the interaction between the retention feature 82 and the rubber segment when the retention feature is seated thereon. For instance, and referring to FIG. 7A, the rubber segment may inhibit the wire members 132 disposed on each side of the wine bottle & can rack 130 from sliding off the inner edge 65 (FIG. 6) of the rails 62. In this manner, the rubber segment creates a non-slip interface that that inhibits the wine and bottle rack 130 from sliding off the rails 62 when the wine and bottle rack 130 is seated thereon. Moreover, the gripping segment is particularly beneficial for making the accessory rack 50 more pleasing in fit and finish, especially in such embodiments that utilize the gripping segments in place of the stop projection 68 and/or the standoff 74.

In some embodiments, the refrigerator appliance can be assembled to include one or more accessory racks 50, such as, for example, when one or more accessory racks 50 are fitted to one or more shelf assemblies 40 prior to the point of sale. In such embodiments, each shelf assembly 40 may comprise a planar panel 46 (e.g., FIG. 3) that includes a front trim member 42, a rear trim member 44, and an accessory rack 50 that is attached thereto, as described in greater detail above. Yet, in other embodiments, the accessory rack 50 can be coupled to other portions of the shelf assembly 40. In some examples, the support arms 52 can be affixed to a lower surface of the planar panel 46. Moreover, in some examples, the accessory rack 50 can be made available to support various refrigerator models or platforms (e.g., as a retrofit item).

Figure 9:
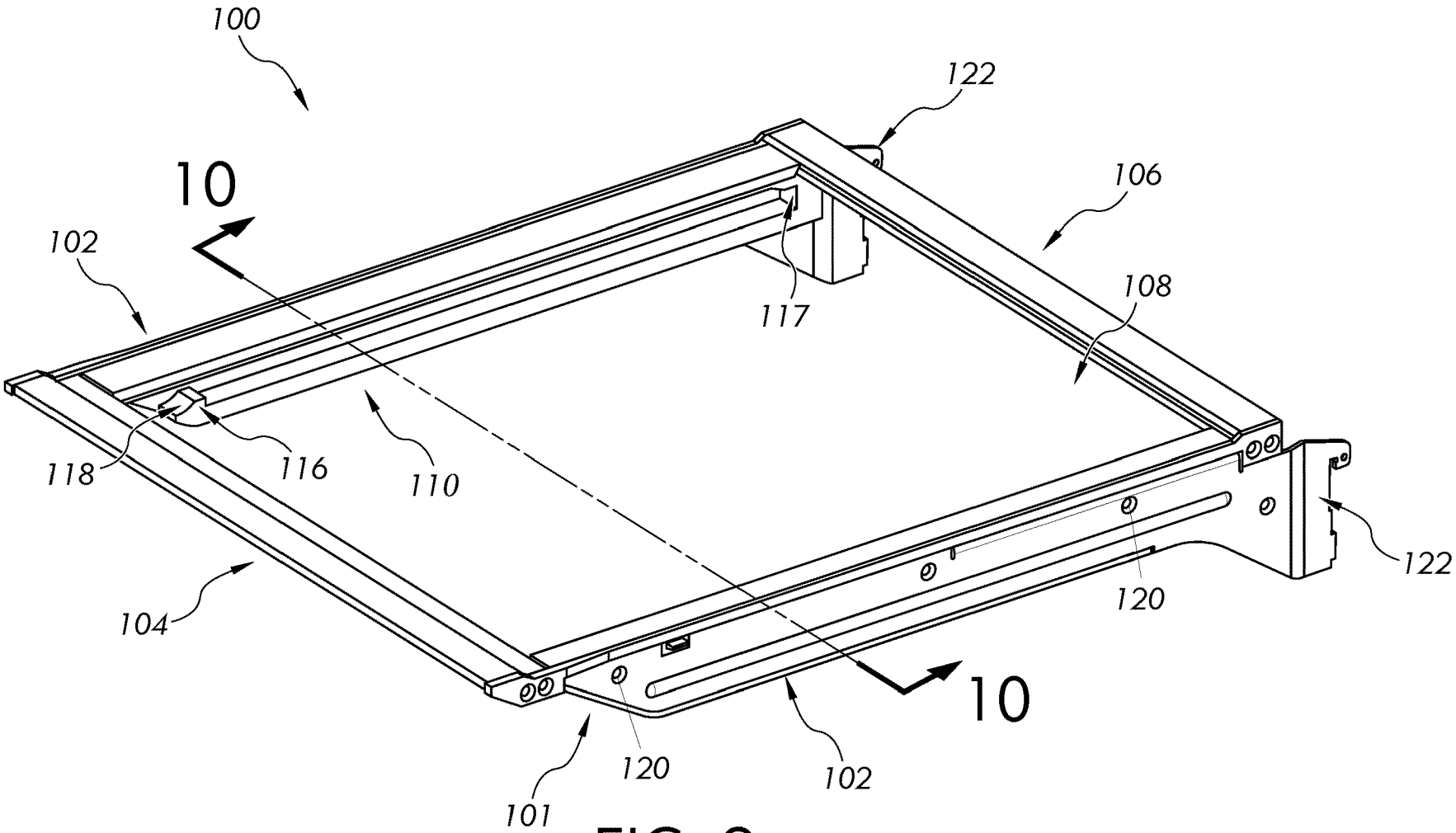
FIG. 9 is a front perspective view of another embodiment of a refrigerator shelf including a multi-accessory rack.
Figure 10:
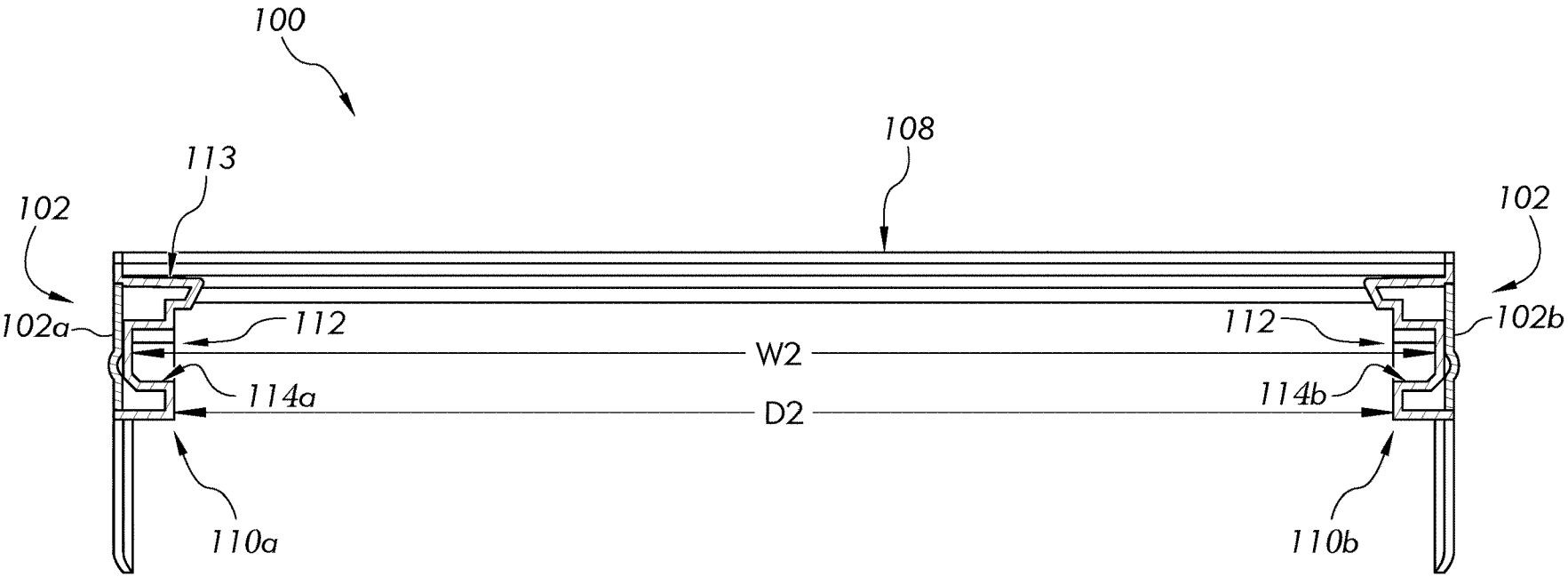
FIG. 10 is a cross-section view of the shelf taken along line 10-10 in FIG. 9.
Figure 11:
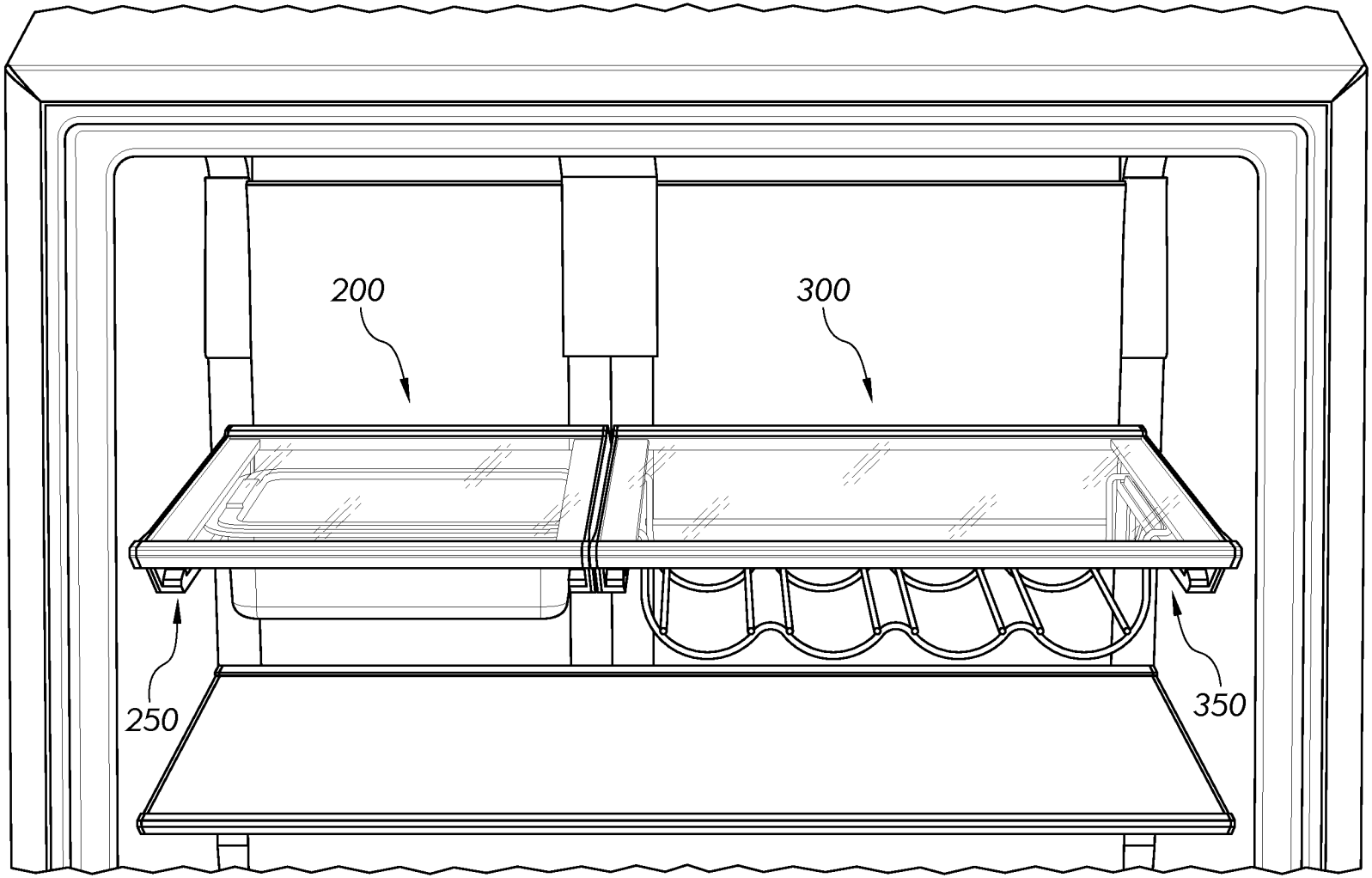
FIG. 11 is a front perspective view of a pair of refrigerator shelves according to the embodiment of FIG. 9.

Turning now to FIGS. 9-11, another exemplary embodiment of a refrigerator shelf-assembly 100 is shown with an integrated accessory rack 101 affixed to a lower portion of the shelf-assembly 100. In distinction to the previous embodiment, this shelf assembly 100 provides a standalone shelf that, together with the integrated accessory rack 101, can be removably installed and re-positioned within the refrigerator appliance. In the illustrated embodiment, the shelf assembly 100 includes a pair of support arms 102 that are spaced apart and connected by at least one of a front trim member 104 and/or a rear trim member 106. The pair of support arms 102 are used to vertically support the shelf assembly 100 within the appliance, such as on shelf rails or the like, and are preferably made of a metal material of suitable strength. A planar panel 108 is supported by the pair of support arms 102 for providing a storage shelf space within the appliance. In some embodiments, the planar panel 108 can be a glass panel, although other rigid materials are contemplated, such as metal or plastic. The front trim member 104 and/or rear trim member 106 can be used to help retain the planar panel 108 upon the support arms 102 and/or can be used to provide a more pleasing appearance.

Referring to FIGS. 9-10, an inward-facing rail 110 is coupled to each support arm 102 via one or more fasteners 120 (e.g., screws, nuts, bolts, clips, and the like) that are preferably removeable. In the illustrated embodiment, fasteners 120 are extended through holes formed in the side of each support arm 102 and into the rail 110 for securing the rail 110 to the support arm 102, although this could be reversed. Each rail 110 is preferably made of plastic, although other rigid materials are also contemplated (e.g., stainless steel, aluminum, etc.). In some examples, each rail 110 may comprise an extrusion, e.g., an aluminum or plastic extrusion. However, in other embodiments, each rail 110 may comprise a plastic-injected-molded component. As shown in FIG. 10, each rail 110 may comprise a cross section that is substantially C-shaped for defining a recessed channel 112 that is configured to accommodate a retention feature disposed on the side of an accessory item, such as, for example, any form of a retention feature and/or accessory item described above with the previous embodiment. While the illustrated embodiment depicts the rail 110 as having a recessed channel 112, it should be appreciated that other configurations are also contemplated. For example, each rail 110 may comprise a cross section that is substantially L-shaped. Yet, in other examples, the rail 110 may embody a contour similar to the rail 62 of the first embodiment described above. Each rail 110 further includes a gliding surface 114 (e.g., 114*a* and 114*b* in FIG. 10) that is located at a lower portion of the recessed channel 112. The gliding surface 114 is configured to slidably receive a retention feature that is to be seated thereon, as described in greater detail above. In the illustrated embodiment, a first gliding surface 114*a* is formed at a lower portion of a first rail 110*a*, and a second gliding surface 114*b* is formed at lower portion of a second rail 110*b*.

In some examples, each rail 110 can be sized and dimensioned to accommodate a variety of interchangeable accessory items, such as the bottle & can rack or storage container described in greater detail above with the previous embodiment. Moreover, the height and/or width of each channel 112 may also be sized and dimensioned to provide sufficient clearance for accommodating protruding features extending past a peripheral edge of the accessory item, such as, for example, the storage container lid 154 of FIG. 8 or an oversized cover. Furthermore, similar to the previous embodiment, the rails 110 may be spaced apart by a distance D2 that is based on a predetermined width W2 that corresponds to the spacing between the retention features disposed on each side of the accessory item (not shown), as described in greater detail above. In this manner, the refrigerator shelf assembly 100 represents a versatile solution for accommodating a wide variety of interchangeable, accessory items therefrom. Moreover, in some embodiments, the refrigerator shelf assembly 100 may include other features, such as, for example, any features of the accessory rack 50 and/or shelf assembly described above.

In further examples, each rail 110 may comprise a low friction, self-lubricating material for enabling the retention feature to slide on the gliding surface 114 of each rail 110. Similarly, and as discussed above, each rail 110 may include a stop projection 116 and/or a rear standoff or rear stop 117 (FIG. 9) to restrain the retention feature for preventing the shelf assembly 100 from sliding off the rails 110 and/or making contact with a rear wall of the liner 24, as described in greater detail above. In this manner, it is also appreciated that each stop projection 116 may include an inclined ramp 118 that is configured to help guide the accessory item into the accessory rack 101. Moreover, the gliding surface 114 of each rail 110 may include a gripping segment disposed thereon to serve as an impediment surface for restraining the retention feature from sliding off the rail 110. For example, the gripping segment can take any suitable form, such as, for example, any form of a gripping segment described above (e.g., a rubber inlay, etc.). In some examples, each rail 110 may include the gripping segment in addition to or in lieu of the stop projection 116 and the rear stop 117.

Referring to FIG. 10, each rail 110 can optionally include an upper ledge 113 that is configured to accommodate a lateral edge of the planar panel 108 which is seated thereon. In this manner, each rail 110 represents a single, multipurpose design that is configured to support the planar panel 108 along its length as well as the accessory item supported therefrom. Referring to FIG. 9, the planar panel 108 may include a front trim member 104 and a rear trim member 106. In some examples, the front trim member 104 and the rear trim member 106 may comprise an aluminum extrusion removably secured at the ends thereof to the support arms 102 by screws or the like. In one example, the front and rear trim members 104, 106 can be secured to the planar panel 108 as a subassembly which is then secured together to the support arms 102 to thereby retain and support the planar panel 108 to form the shelf. Yet, in other examples, the front trim member 104 and the rear trim member 106 can be made from any other rigid material suitable for use in a refrigerator appliance (e.g., stainless steel, plastic, etc.).

Referring back to FIG. 9, each support arm 102 may further include a rear mounting hook 122 extending therefrom that is configured to removably attach the shelf assembly 100 to a rear wall of the refrigerator liner 24, e.g., into a vertical rail attached to or thermoformed into the rear wall of the liner 24. Often, these rails are referred to as a "ladder track" since they include a plurality of spaced-apart holes to receive the shelf hook 122 and thereby enable the lateral position and/or height of the shelf assembly 100 to be vertically adjusted within the appliance cabinet. In some embodiments, each mounting hook 122 may be integrally formed onto each support arm 102, particularly in such embodiments where the support arm 102 comprises a single metal stamping or a single plastic injection molded component.

Referring to FIG. 11, in some examples, the refrigerator compartment may include two or more shelf assemblies (e.g., 100) each fitted with an accessory rack (e.g., 101). In the illustrated embodiment, a first shelf assembly 200 may include a first accessory rack 250, and a second shelf assembly 300 may include a second accessory rack 350. In such examples, the front trim member of each of the shelf assemblies 200 and 300 can be made slightly wider than a corresponding rear trim member to minimize and/or conceal a gap that may otherwise exist between the shelf assemblies 200 and 300 for making the refrigerator compartment aesthetically more pleasing in fit and finish. In this manner, it should be understood that the accessory racks of the present disclosure may be sized and dimensioned to correspond with various sized accessory items and/or refrigerator compartments (e.g., fresh food compartment or freezer compartment, and refrigerator configurations (e.g., side-by-side, bottom mount, top mount, French door, etc.). As shown in FIG. 11, the shelf assemblies 200, 300 are illustrated in an asymmetrical arrangement, whereby each shelf has a different width. It is also contemplated that the shelf assemblies 200, 300 can have a symmetrical arrangement with the same width, whereby the supported accessory items can be interchangeably supported by either shelf assembly 200, 300.

Turning back to FIG. 7A, a description of the wine bottle & can rack 130 will now be described in greater detail. In the illustrated embodiment, the bottle and can rack 130 may include a plurality of longitudinal frame members 134 that are spaced apart and connected by a pair of elongated wire members 132. In the illustrated embodiment, the elongated wire members 132 are configured to connect the longitudinal frame members 134 but also are suited to serve as retention features for suspending the bottle & can rack 130 from the rails of an accessory rack, such as, for example, any form of an accessory rack described herein. In the illustrated embodiment, the longitudinal frame members 134 and the elongated wire members 132 are shaped and formed from a corrosion resistant, shaped-wire that is suitable for use in a refrigerator appliance (e.g., stainless steel wire). However, it is appreciated that other material selections are also contemplated (e.g., plastic, aluminum, etc.). In some examples, each elongated wire member 132 may include a longitudinal jacket (not shown) disposed around each elongated wire member 132. The longitudinal jacket may include a substantially flat, lower surface that is comprised of a self-lubricating material such that each elongated wire member 132 may slide along a rail of the accessory rack.

Still referring to FIG. 7A, each longitudinal frame member 134 features a substantially sinusoidal-shaped contour. In this manner, each longitudinal frame member 134 may include two or more arcuate-shaped seating elements 140 having a contour corresponding to the shape of a bottle and a can. Each longitudinal frame member 134 may also include one or more peaks 146 located between each of the seating elements 140. In the illustrated embodiment, a plurality of parallel rods 144 may extend between the longitudinal frame members 134. More specifically, terminal ends of each parallel rod 144 may connect to the longitudinal frame members 134 on opposite sides of each peak 146, respectively. Notably, the parallel rods 144 can be spaced apart on each seating element 140 such that the spacing is less than the width of a bottle and/or a can. This feature is particularly advantageous for enabling the bottle & can rack 130 to be multi-functional in supporting a variety of beverage bottles and/or cans. For example, wine bottles can be supported at least via a trough of the seating elements 140, while cans are able to be supported by a pair of the parallel rods that are located above each trough. Each wine bottle & can rack 130 may optionally also include a rear stop-bar (not shown) connected to opposite sides of the rear longitudinal frame member 134, respectfully, for preventing a bottle or can from contacting a rear wall of the liner.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims and their equivalents.

What is claimed is:

1. An accessory rack for suspending interchangeable accessories from a refrigerator shelf, the accessory rack comprising:

a first support arm and a second support arm spaced apart and connected by a front cross member and a rear cross member, wherein the first support arm and the second support arm each comprises a substantially C-shaped clip extending forwardly and wherein the rear cross member comprises an elongated lip extending rearwardly, wherein the C-shaped clips are configured to slidably engage a front portion of said shelf and wherein the elongated lip is configured to slidably engage a continuous channel formed in a rear portion of said shelf such that the accessory rack as a whole may freely slide transversely about said shelf in a state wherein the accessory rack is coupled therewith; and a first rail and a second rail extending inwardly, wherein the first rail is formed on the first support arm, and wherein the second rail is formed on the second support arm, wherein the first rail and the second rail each comprises a flat upper surface extending along a substantial longitudinal length thereof, wherein the first rail and the second rail support a plurality of different accessories, wherein each of said plurality of different accessories comprises:

an item selected from the group consisting of a bottle rack, a container, a tray, and a hanging shelf, and a pair of retention features spaced apart by a first predetermined width, wherein the first rail and the second rail are spaced apart based on a second predetermined width that is fixed and less than the first predetermined width such that said pair of retention features slidably engage and rest against the upper surfaces of the first and second rails to thereby suspend each of said plurality of different accessories therefrom.

2. The accessory rack according to claim 1, wherein a first stop projection is formed on the upper surface of the first rail at a front portion thereof, and wherein a second stop projection is formed on the upper surface of the second rail at a front portion thereof, wherein the first stop projection and the second stop projection are configured to inhibit said pair of retention features from sliding off of the upper surfaces of the first and second rails in a forward direction, wherein a first standoff is formed on the upper surface of the first rail at a rear portion thereof and wherein a second standoff is formed on the upper surface of the second rail at a rear portion thereof, wherein the first standoff and the second standoff are configured to engage a retention feature of said pair of retention features to thereby inhibit each of said plurality of different accessories from contacting a rear portion of a refrigerator liner, wherein a first ramp is formed at a front portion of the first stop projection, and wherein a second ramp is formed at a front portion of the second stop projection, wherein the first ramp and the second ramp are upwardly inclined and configured to respectively guide said pair of retention features onto the first rail and the second rail, wherein the first rail and the second rail each comprises a self-lubricating plastic adapted to enable said pair of retention features to respectively glide along the first and second rails, wherein the C-shaped clips and the lip each comprises a self-lubricating plastic to facilitate the accessory rack to freely slide transversely about said shelf as a whole, and wherein the lip is configured to slidably engage a channel formed in a rear portion of said shelf.

3. The accessory rack according to claim 1, wherein a first gripping segment is disposed on the upper surface of the first rail, and wherein a second gripping segment is disposed on the upper surface of the second rail, wherein the first gripping segment and the second gripping segment are configured to restrain said pair of retention features from sliding on the first rail and the second rail.

4. A refrigerator appliance comprising:

an interior liner including opposing side walls and a rear wall collectively defining a fresh food compartment;

a refrigerator shelf extending transversely between the opposing side walls of the liner, wherein the refrigerator shelf comprises:

a planar panel for storing items thereon, the panel including a front trim member and a rear trim member; and an accessory rack removably attached to the front trim member and to the rear trim member and suspending a plurality of interchangeable accessories from the refrigerator shelf; the accessory rack comprising:

a first support arm and a second support arm spaced apart and connected by a front cross member and a rear cross member, wherein the first support arm and the second support arm each comprises a substantially C-shaped clip extending forwardly and wherein the rear cross member comprises an elongated lip extending rearwardly, wherein the C-shaped clips slidably engage a front portion of said shelf and wherein the elongated lip slidably engages a rear portion of said shelf such that the accessory rack as a whole may freely slide transversely about said shelf and between the opposing side walls of the liner in a state wherein the accessory rack is coupled therewith; and a first rail and a second rail extending inwardly, wherein the first rail is formed on the first support arm, and wherein the second rail is formed on the second support arm, wherein the first rail and the second rail each comprises a flat upper surface extending along a substantial length thereof, wherein the first rail and the second rail support each of said plurality of interchangeable accessories, wherein each of said plurality of interchangeable accessories comprises:

an item selected from the group consisting of a bottle rack, a container, a tray, and a hanging shelf, and a pair of retention features spaced apart by a first predetermined width, wherein the first rail and the second rail are spaced apart based on a second predetermined width that is fixed and less than the first predetermined with such that said pair of retention features slidably engage and rest against the upper surfaces of the first and second rails to thereby suspend each of said plurality of interchangeable accessories therefrom.

5. A refrigerator shelf, comprising:

a front trim member and a rear trim member;

a planar panel for storing items thereon; and an accessory rack removably attached to the front trim member and the rear trim member and suspending a plurality of interchangeable accessories from the refrigerator shelf, the accessory rack comprising:

a first support arm and a second support arm spaced apart and connected by a front cross member and a rear cross member, wherein the first support arm and the second support arm each comprises a substantially C-shaped clip extending forwardly, and wherein the rear cross member comprises an elongated lip extending rearwardly, wherein the C-shaped clips slidably engage a front portion of said shelf and wherein the elongated lip slidably engages a rear portion of said shelf such that the accessory rack as a whole may freely slide transversely about said shelf in a state wherein the accessory rack is coupled therewith;

a first rail and a second rail, wherein the first rail is coupled to the first support arm, and wherein the second rail is coupled to the second support arm, wherein the first rail and the second rail each comprises a flat upper surface extending along a substantial length thereof; and wherein the first rail and the second rail support the plurality of interchangeable accessories, each of said accessories comprising:

a pair of retention features spaced apart by a predetermined width, and an item selected from the group consisting of a bottle rack, a container, a tray, and a hanging shelf;

wherein the first rail and the second rail are spaced apart based on said predetermined width such that each of said plurality of accessories are interchangeably suspended from first rail and the second rail via said pair of retention features slidably engaging and resting against the upper surfaces of the first and second rails.

6. The refrigerator shelf according to claim 5, wherein the first rail and the second rail are configured to slidably receive said pair of retention features disposed on each of said plurality of different accessories.

7. The refrigerator shelf according to claim 5, wherein the first rail and the second rail each comprises a self-lubricating material to enable said pair of retention features to glide along the first rail and the second rail.

8. The refrigerator shelf according to claim 5, wherein a first stop projection is disposed at a front portion the first rail, and wherein a second stop projection is disposed at a front portion of the second rail, wherein the first stop projection and the second stop projection are configured to inhibit each of said plurality of different accessories from sliding off of the first rail and the second rail.

9. The refrigerator shelf according to claim 8, wherein a first ramp is formed at a front portion of the first stop projection, and wherein a second ramp is formed at a front portion of the second stop projection, wherein the first ramp and the second ramp are upwardly inclined and configured to guide the insertion of each of said plurality of different accessories onto the first rail and the second rail.

10. The refrigerator shelf according to claim 5, wherein a first rear stop is disposed at a rear portion of the first rail, and wherein a second rear stop is disposed at a rear portion of the second rail, wherein the first rear stop and the second rear stop are configured to inhibit each of said plurality of different accessories from contacting a rear portion of a refrigerator liner.

11. The refrigerator shelf according to claim 5, wherein a first gripping segment is disposed on the first rail, and wherein a second gripping segment is disposed on the second rail, wherein the first gripping segment and the second gripping segment are configured to restrain said pair of retention features from sliding on the first rail and the second rail.

* * * * *